US007422392B2

(12) United States Patent
Obermeyer

(10) Patent No.: US 7,422,392 B2
(45) Date of Patent: Sep. 9, 2008

(54) WATER CONTROL STRUCTURE

(76) Inventor: Henry K. Obermeyer, 303 W. County Rd., Wellington, CO (US) 80549

( * ) Notice: Subject to any disclaimer, the term of this patent is extended or adjusted under 35 U.S.C. 154(b) by 37 days.

(21) Appl. No.: 11/240,874

(22) Filed: Oct. 1, 2005

(65) Prior Publication Data

US 2006/0078388 A1 Apr. 13, 2006

Related U.S. Application Data

(60) Provisional application No. 60/616,761, filed on Oct. 6, 2004.

(51) Int. Cl.
*E02B 7/00* (2006.01)

(52) U.S. Cl. ..... 405/87; 405/107; 405/100

(58) Field of Classification Search ..... 405/87–94, 405/99, 100, 107, 115
See application file for complete search history.

(56) References Cited

U.S. PATENT DOCUMENTS

| | | | | |
|---|---|---|---|---|
| 419,287 | A | 1/1890 | Scaife | |
| 2,335,327 | A | 11/1943 | Wellons | 61/27 |
| 2,622,404 | A | 12/1952 | Rice | 61/46 |
| 3,718,002 | A | 2/1973 | Aubert | 61/22 |
| 3,720,067 | A | 3/1973 | Aubert | 61/46 |
| 3,775,983 | A | 12/1973 | Aubert | 61/26 |
| 3,938,342 | A | 2/1976 | Aubert | 61/46 |
| 4,015,554 | A | 4/1977 | Chow | 114/65 |
| 4,112,697 | A | 9/1978 | Chow | 405/209 |
| 4,352,592 | A | 10/1982 | Aubert | 405/102 |
| 4,881,848 | A | 11/1989 | Wright et al. | 405/116 |
| 5,178,490 | A | 1/1993 | Snowberger et al. | 405/102 |
| 5,195,846 | A * | 3/1993 | Lemperiere | 405/108 |
| 5,642,963 | A * | 7/1997 | Obermeyer | 405/100 |
| 5,709,502 | A * | 1/1998 | Obermeyer | 405/87 |
| 6,196,764 | B1 * | 3/2001 | Bayssiguier | 405/87 |
| 6,431,792 | B1 | 8/2002 | Barnes | 405/25 |
| 6,659,686 | B2 | 12/2003 | Veazey | 405/16 |

* cited by examiner

*Primary Examiner*—Frederick L. Lagman

(57) ABSTRACT

The invention relates to improved pneumatically operated spillway gate systems and methods of constructing and operating the same. Methods of installation without the requirement for coffer dams are disclosed. A maintenance service dewatering box and service crane is also disclosed

9 Claims, 23 Drawing Sheets

WATER CONTROL STRUCTURE

NOTE: This nonprovisional patent application is cross referenced and claims the benefit of my provisional application No. 60/616,761, WATER CONTROL STRUCTURE, filed Oct. 6, 2004.

BACKGROUND OF THE INVENTION

1. Field of Invention

The present invention relates to pneumatically actuated water control gates and the installation and maintenance methods therefore.

2. Description of Related Art

Pneumatically operated water control gates are well known. Prior art includes U.S. Pat. No. 4,780,024 October 1998 to Obermeyer et. al., U.S. Pat. No. 5,092,707 March 1992 to Obermeyer, U.S. Pat. No. 5,538,360 July 1996 to Obermeyer, U.S. Pat. No. 5,642,963 July 1997 to Obermeyer, U.S. Pat. No. 5,709,502 January 1998 to Obermeyer, U.S. Pat. No. 5,713,699 February 1998 to Obermeyer et. al., European Patent Application Number 02746956 July 2002 Obermeyer, Henry K., International Application Number is PCT/US02/21766.

Construction of underwater structures which include pre-cast concrete portions are also well known. Such construction has, in the past, been hindered by the strength limitations of newly pre-cast concrete elements and by the difficulty involved with turning them over and placing them without damage and without waiting for substantially full cure of the concrete. In the interest of economy, pre-cast concrete slab-like shapes need to be large. In order to limit weight to within the capacity of available lifting equipment such slab-like shapes need to be relatively thin. Construction methods of the prior art have used concrete forms to establish the shape and dimensions of the slab-like structures and then used elaborate lifting beams to carefully distribute loads during lifting, transport and placement.

Conventional water control gate systems across wide rivers or other bodies of water usually incorporate a plurality of intermediate piers that may be used to locate and support movable dewatering bulkheads and gate operating equipment. Such piers are expensive, create excessive and concentrated foundation loads, and may be undesirably susceptible to earthquake damage. Such piers also pose a serious hazard to navigation, especially under high flow conditions when the gates between piers are open.

Other water control gate systems of prior art such as described in U.S. Pat. No. 5,178,490 utilize hydraulic cylinders mounted beneath a plurality of water control gates. Such systems generally require expensive access tunnels and require labor and equipment intensive methods for dewatering for maintenance and repair. Furthermore, hydraulic cylinders, when used in a submerged river environment, are prone to corrosion, abrasion damage, impact damage, and oil leakage.

SUMMARY OF INVENTION

It is an object of this invention to provide a system of water control gates which may be installed without the use of coffer dams and which may be individually dewatered and serviced without the requirement for intermediate piers traditionally used to secure stop logs.

A further object of this invention may be to provide a simple robust dewatering bulkhead in conjunction with a service crane.

An object of one embodiment of this invention is to provide a generally U plan shaped flow shut off bulkhead in conjunction with a generally box plan shaped dewatering bulkhead in order to facilitate dewatering bulkhead placement under non-flow conditions or to allow complete lowering of the gate to be dewatered prior to dewatering bulkhead placement.

A further object of this invention is to provide a gate foundation structure comprised of pre-cast concrete sections while avoiding the need to perform any heavy lifts.

A further object of this invention is to structurally support the pre-cast concrete sections during placement in order to permit the use of lighter sections and to permit placement soon after pouring of the pre-cast concrete sections. In a preferred embodiment, a concrete form system is provided which is sufficiently rigid to ensure dimensional accuracy required for fitting of adjoining concrete parts and also sufficiently strong to be used for lifting such concrete parts into final position. The form system is preferably equipped with controllable ballast tanks in order to minimize or eliminate the need for heavy lifting equipment. Such ballast tanks may be readily provided by constructing major elements of the form system as hollow closed box-like structures. Such closed box-like structures inherently provide excellent rigidity in both bending and torsion and thereby aid in fulfilling the requirement for form rigidity. Such a form system is preferably configured to allow the forming and pouring of an inverted concrete foundation parts, the rotation of said foundation parts to upright positions, the assembly of a water control gate systems thereon, the transport of the resulting concrete foundation mounted water control gate systems, and the successive placement into final position of said systems.

It is a further object of this invention to provide pre-cast sections with a high quality smooth formed upper surface including any required anchor bolts, embeds, block-outs and the like. Such a surface is particularly desirable for use in association with pneumatically actuated water control gates. Such an upper surface is most readily provided by forming it against the lower face of a floating concrete form in accordance with one embodiment of this invention.

It is a further object of an embodiment of this invention to provide rebar dowels protruding from the lower (relative to installed orientation) surface of the pre-cast concrete sections. It is a further object of such an embodiment of this invention to provide a roughened lower (relative to installed orientation) surface for bonding to the underlying and subsequently placed tremie concrete. Both of these objects are facilitated by use of an overturnable floating concrete form in accordance with one aspect of one embodiment of this invention.

It is a further object of this invention to provide pre-cast concrete sections with the associated portion of water control gate installed prior to submergence of said pre-cast concrete sections. For this purpose, a removable form portion used to form the spillway gate mounting surface is preferably provided.

It is a further object of this invention to eliminate or minimize the requirement for intermediate piers within the span of a water control gate system.

It is a further object of this invention to provide pneumatic control conduits which may be installed underwater and which may be readily serviced or replaced in the future as may be required.

It is a further object of this invention to provide a pneumatic control scheme which is redundant and thereby not subject to single point failure.

A further object of this invention is to enable the dewatering of any one gate while not obstructing the full range of motion of adjoining gates.

It is a further object of this invention to enable the dewatering of any one gate while not obstructing the full range of motion of adjoining gates while also providing sealing surfaces (abutment plates) for the adjoining gates to seal against while one or more gates are dewatered for service.

It is the object of one aspect of this invention to enable the dewatering of any one gate with a dewatering box sealed against each adjacent gate while providing sealing surfaces (abutment plates) for the $2^{nd}$ gate in each direction fro the gate being dewatered.

DETAILED DESCRIPTION OF THE PREFERRED EMBODIMENTS

Figure 1A:
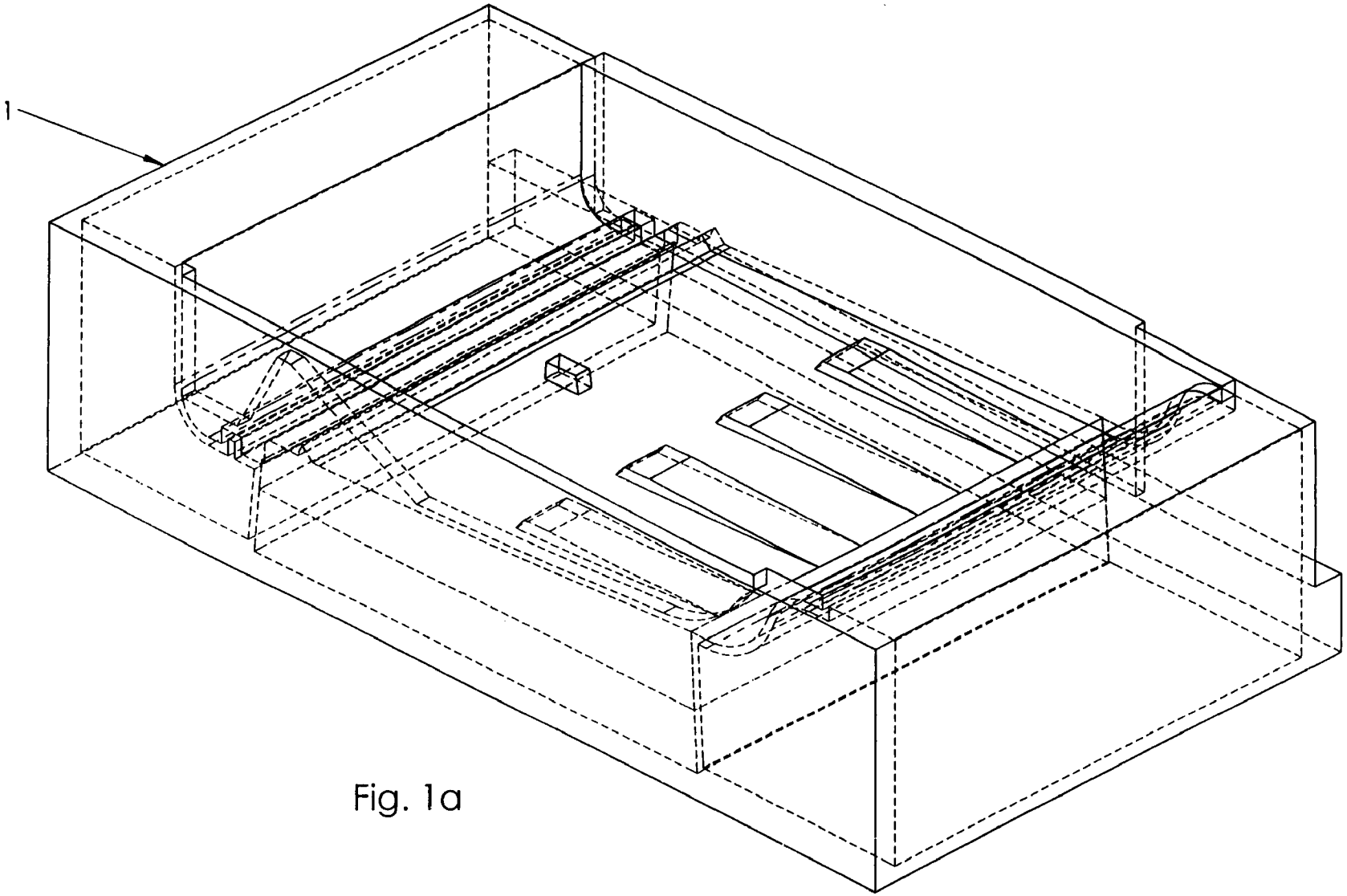
FIGS. 1*a* through 1*h* depict various stages of construction of a water control structure in accordance with one aspect of this invention.
Figure 1B:
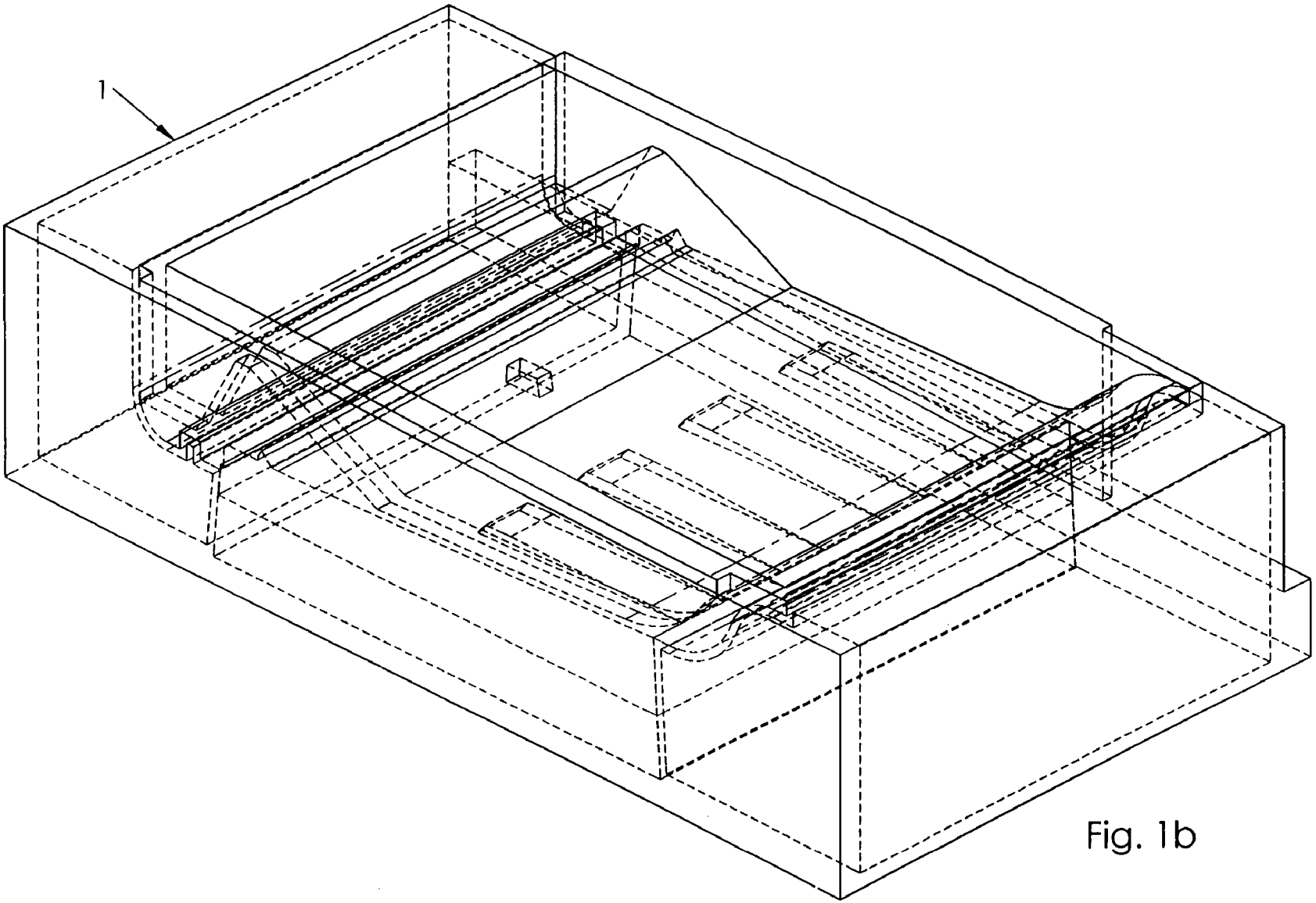
Figure 1C:
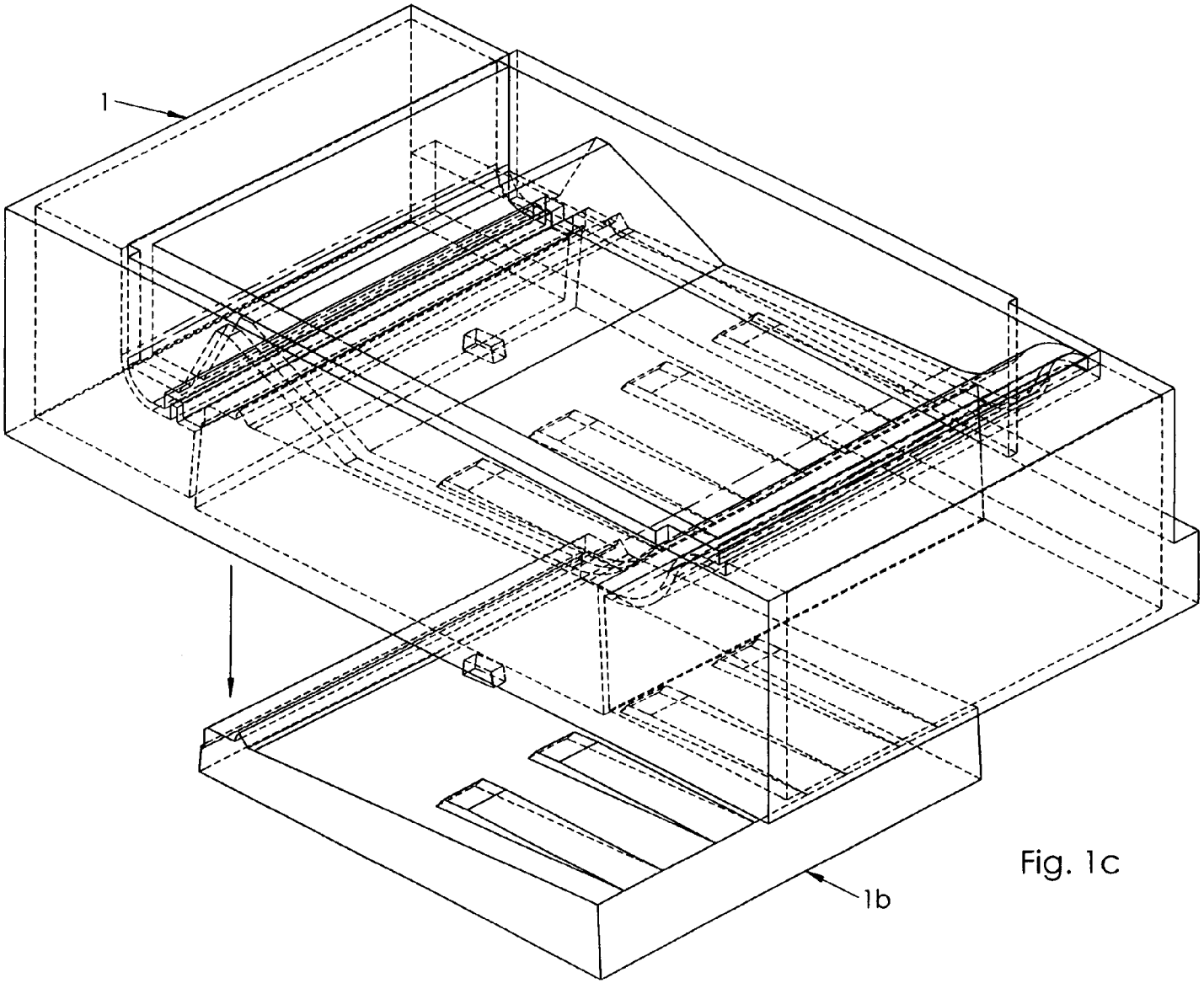
Figure 1D:
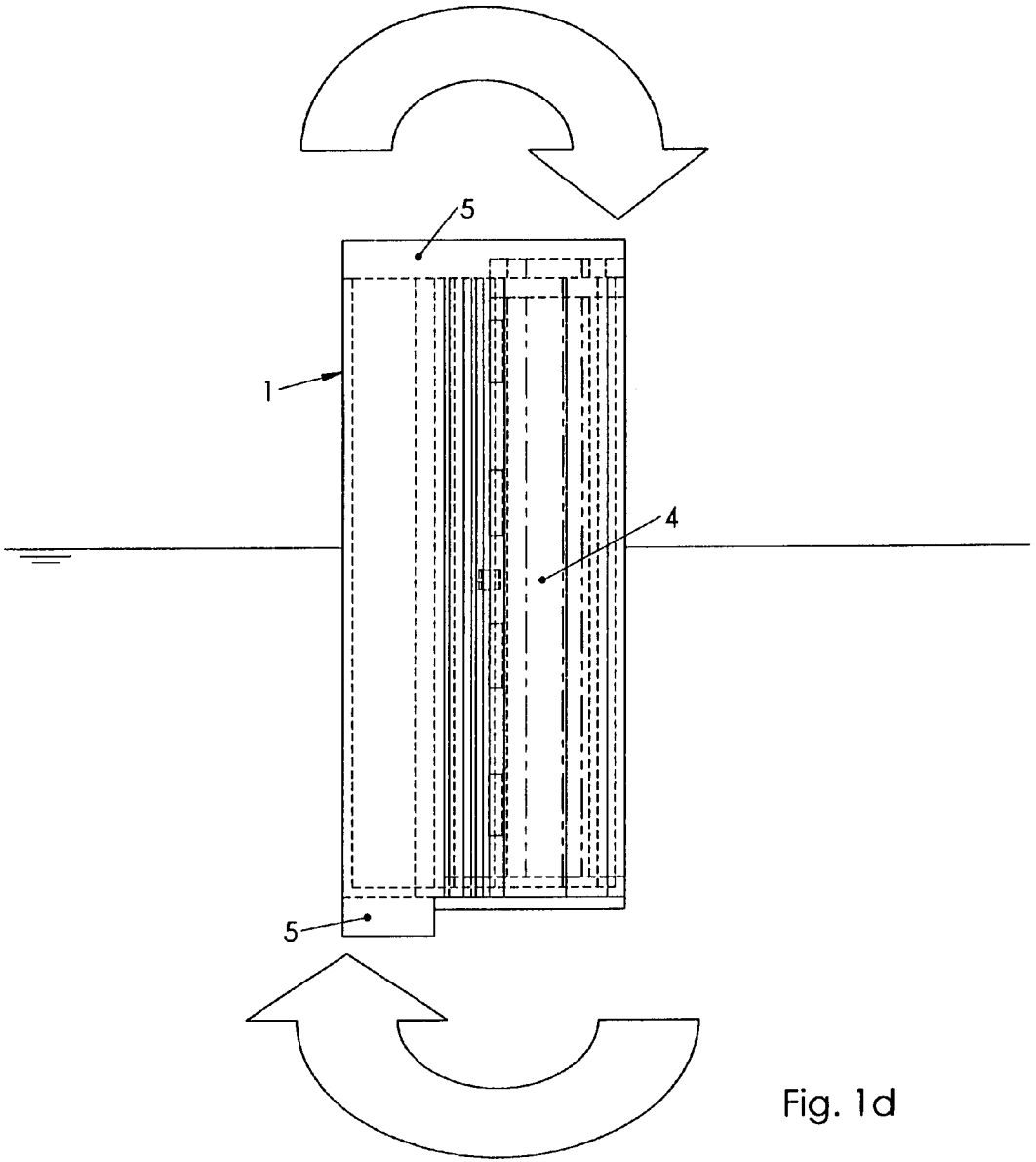
Figure 1E:
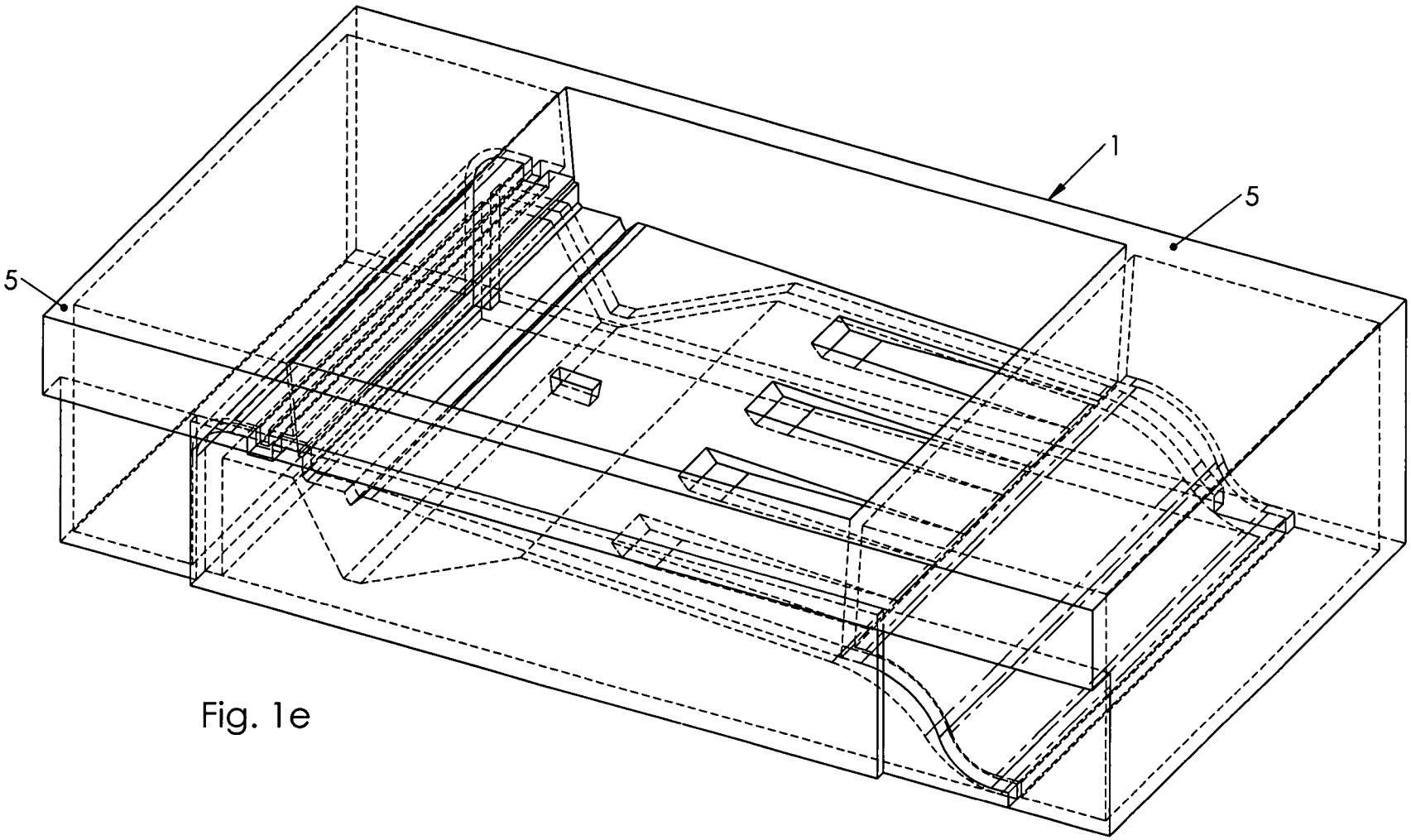
Figure 1F:
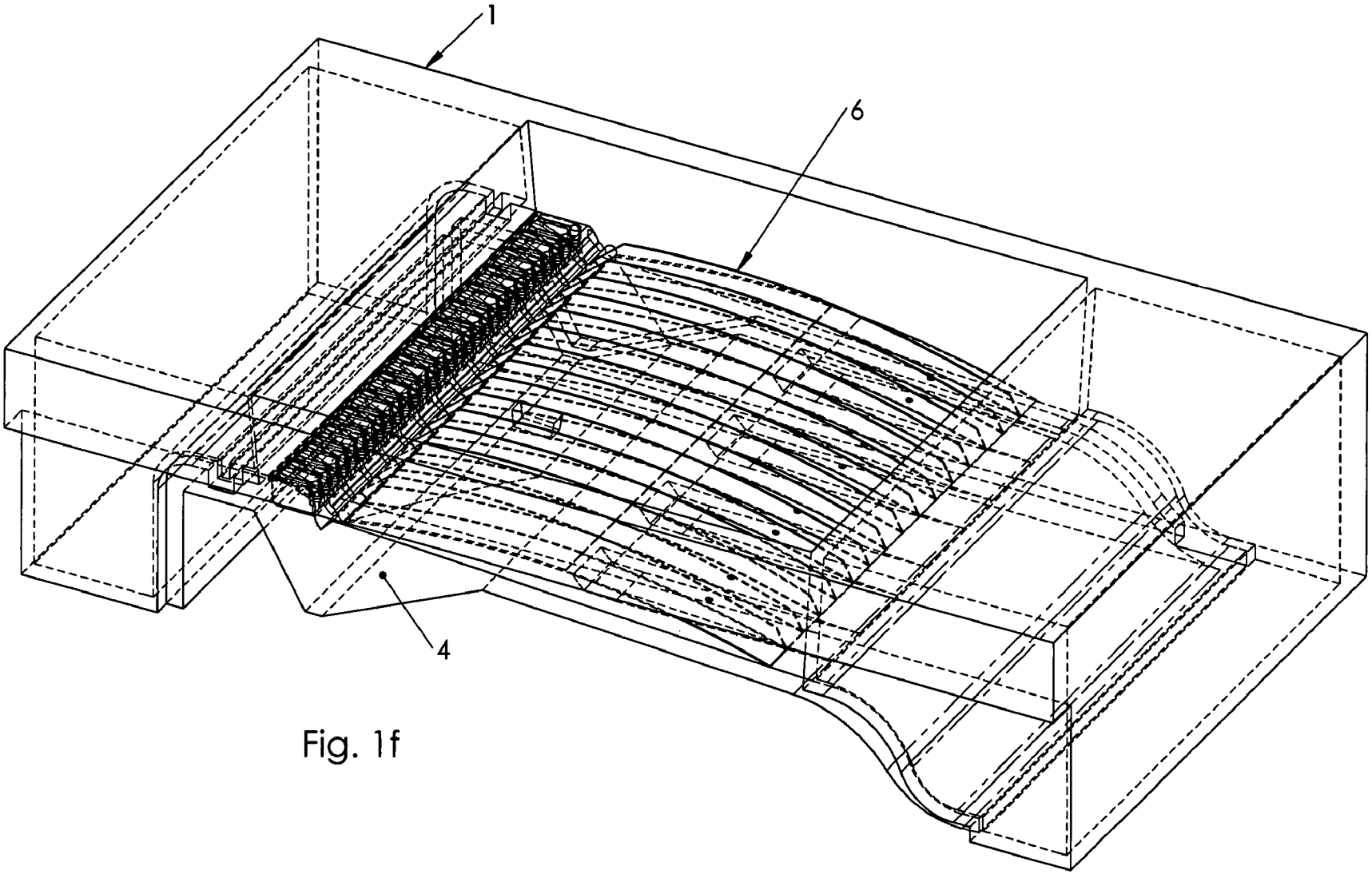
Figure 1G:
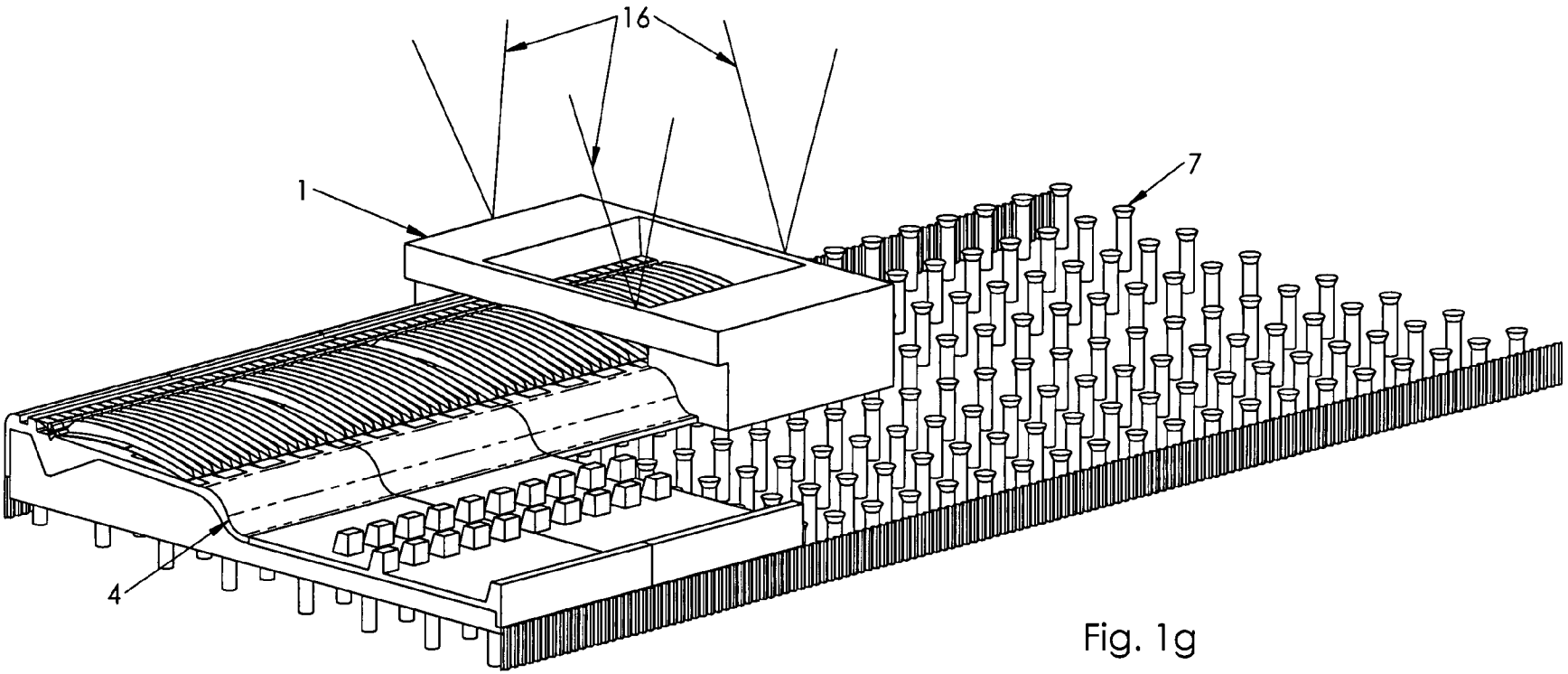
Figure 1H:
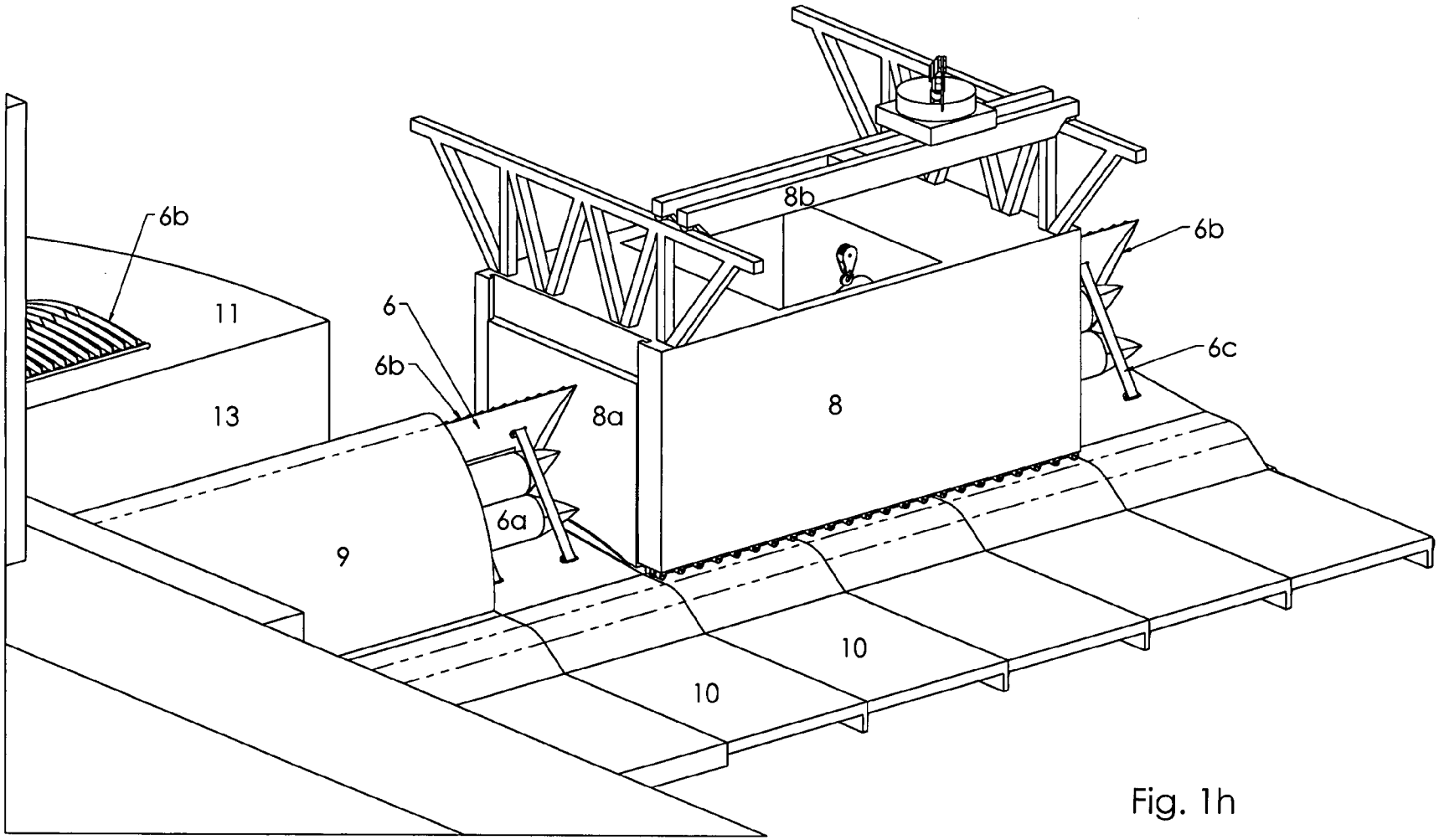

Referring to FIG. 1*a*, floating form 1 is first fitted with rebar and any required embedded items such as anchor bolts Referring to FIG. 1*b*, a concrete foundation shell 4 is cast in floating form 1. Referring to FIG. 1*c*, gate mounting surface panel 1*b* is removed from floating form 1. Referring to FIG. 1*d*, floating form 1 containing pre-cast shell 4 is overturned controlling the relative air and water content of differential ballast chambers 5. Referring to FIG. 1*e*, pre-cast shell 4 is now ready for installation of a pneumatic gate assembly. Referring to FIG. 1*f*, a gate system 6 is shown installed onto pre-cast shell 4. Referring to FIG. 1*g*, floating form 1 is lowered to position one of the pre-cast shells 4. Such lowering may be by means of a six degree of freedom rope hoist arrangement 16. Pre-cast shells 4 are preferably supported on piles 7 and adjusted by means of inflatable grout bags or jacking screws, for example. Referring to FIG. 1*h*, a completed installation is shown including service crane 8, gates 6, stilling basin pre-cast shells 10, abutment weir 9, service platform 11, and bridge crane 8*b*. Abutment weir 9 is configured to allow crane stowage while preventing flow through the crane stowage area 13. Abutment weir 9 features a smooth sealing surface to which nearest gate 6 seals. Service crane 8 is preferably built with ballast chambers in order to allow floatation to the job site as well as enhanced stability when completely water filled. Slide gates 8*a* at each end of service crane 8 allow serve as temporary abutment plates when lowered and also seal to lowered gates 6 on each side of the gate to be serviced.

Figure 2A:
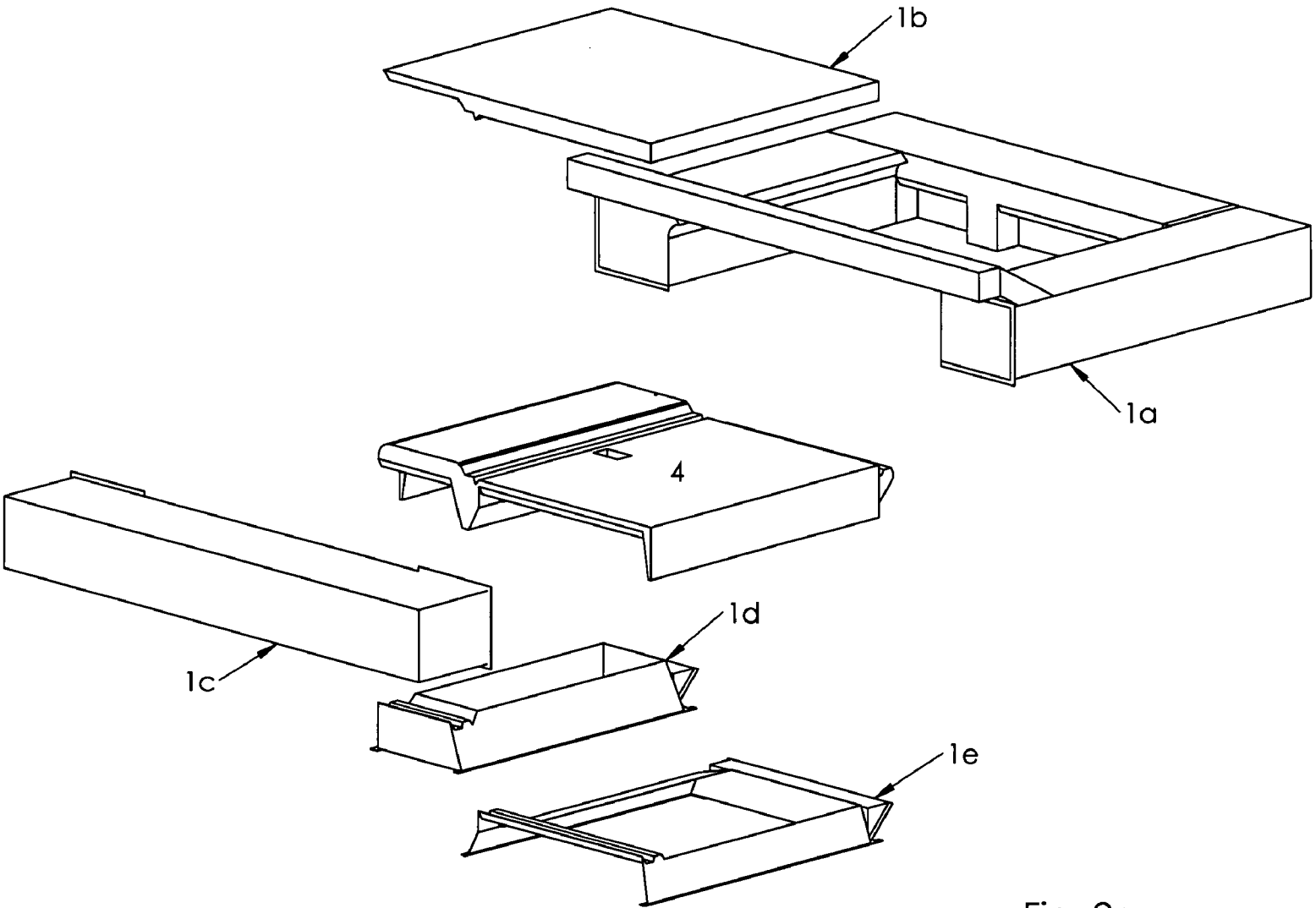
FIGS. 2*a* through 2*n* depict various stages of construction of a water control structure in accordance with another aspect of this invention.
Figure 2B:
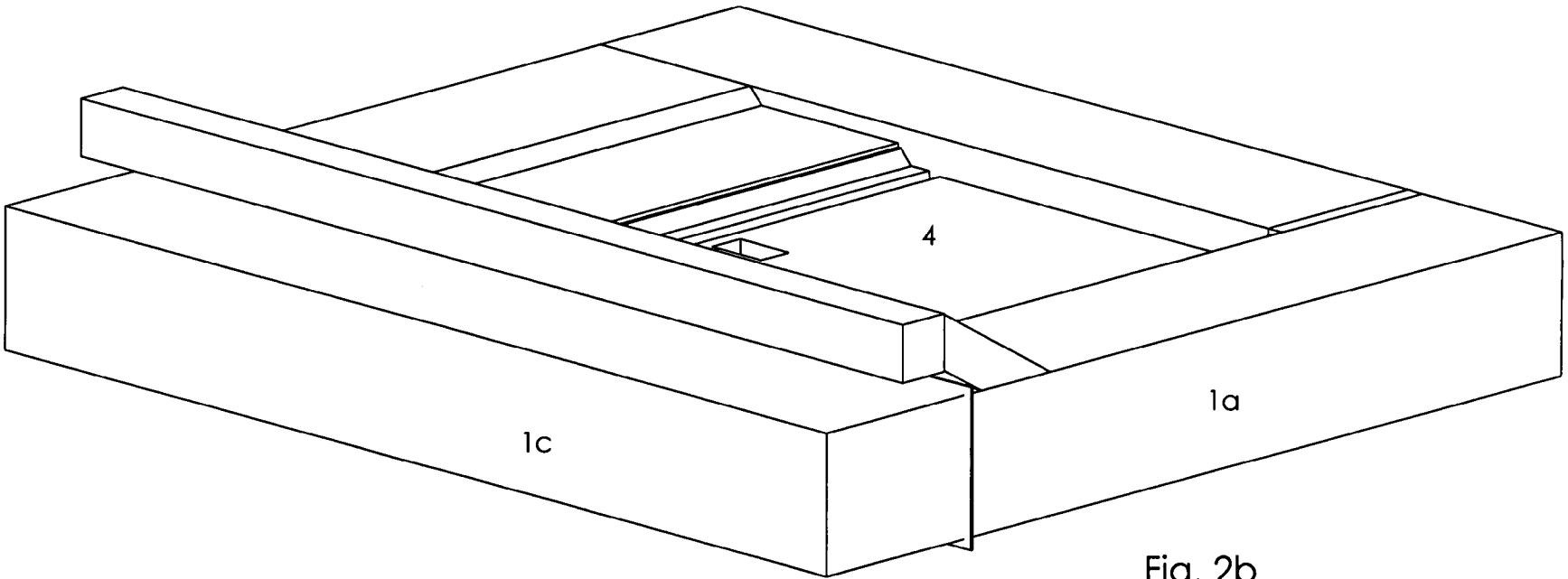
Figure 2C:
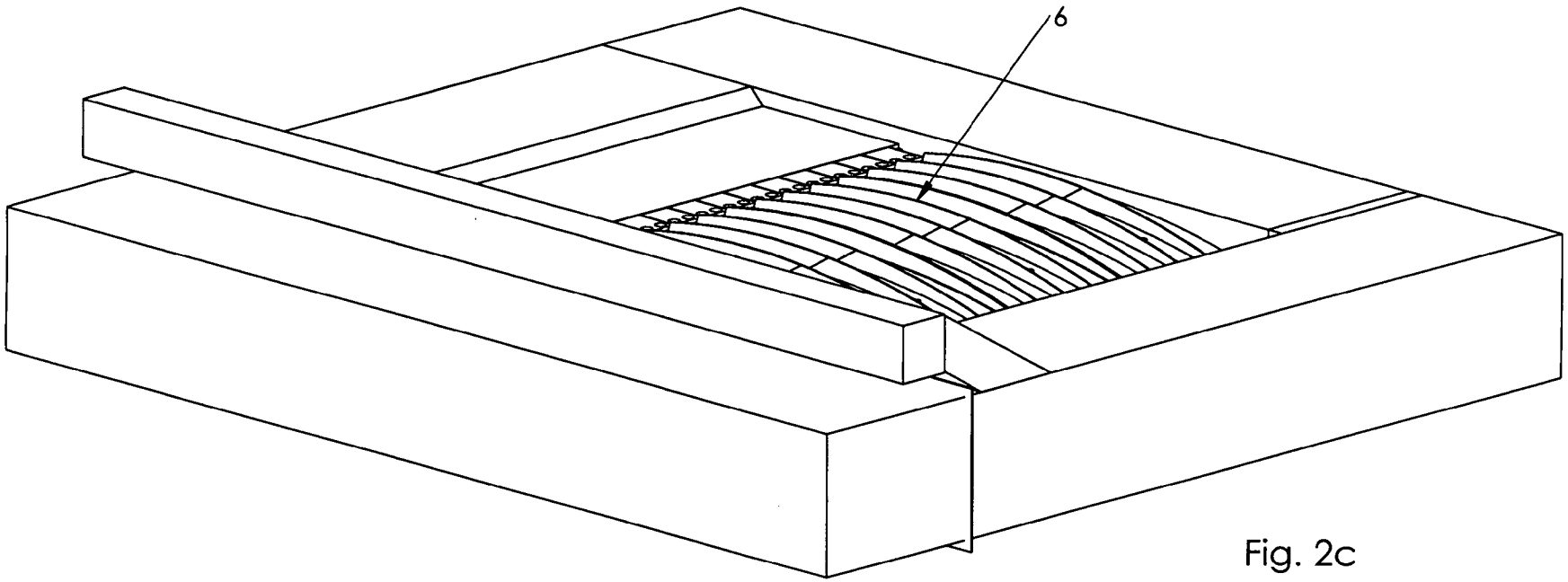
Figure 2D:
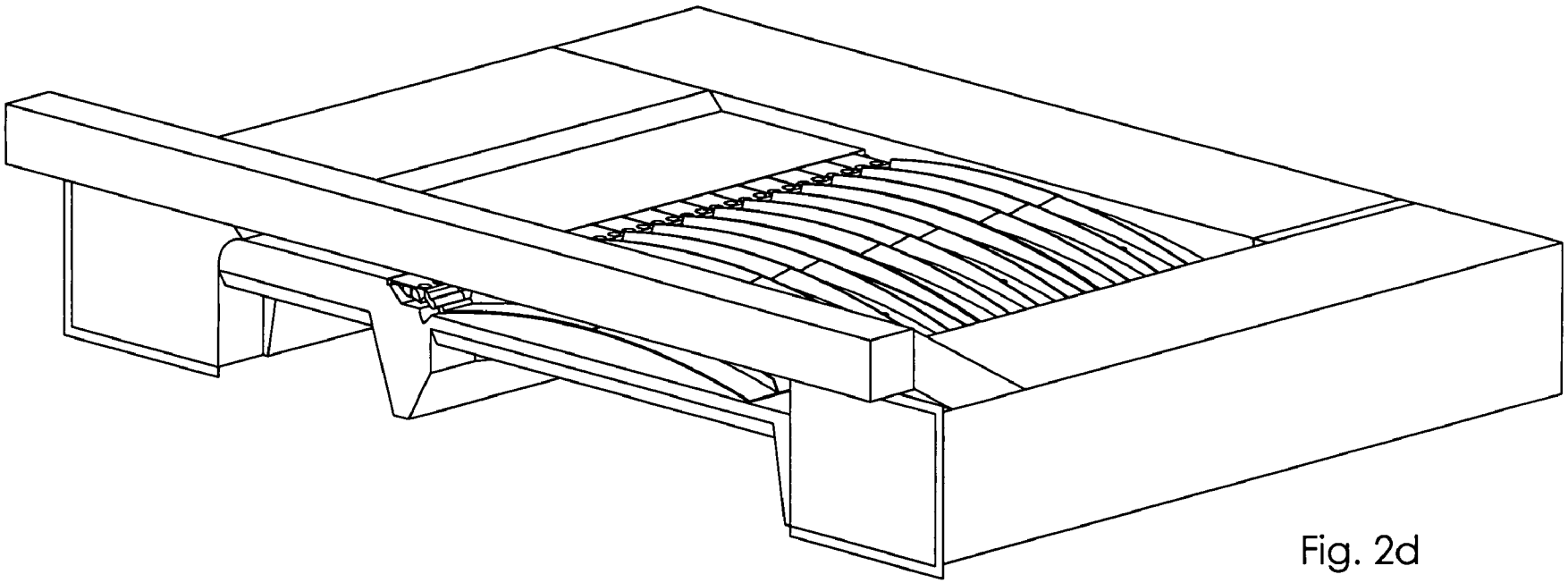
Figure 2E:
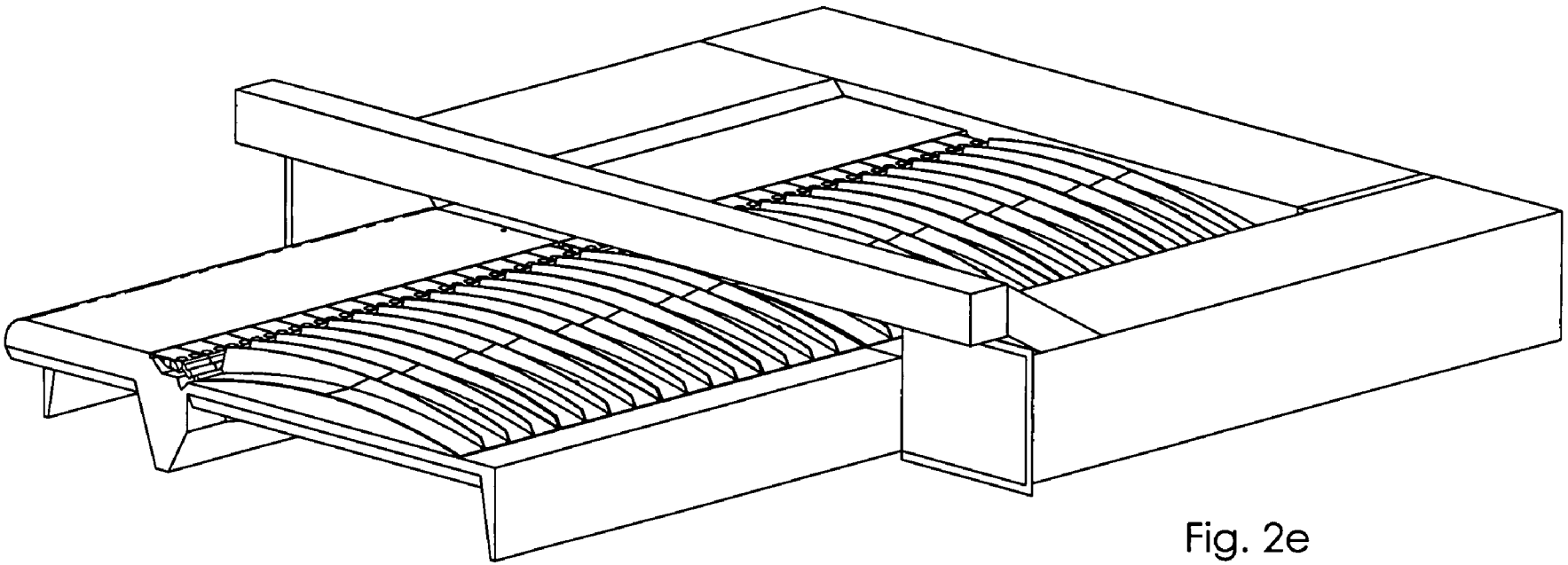
Figure 2F:
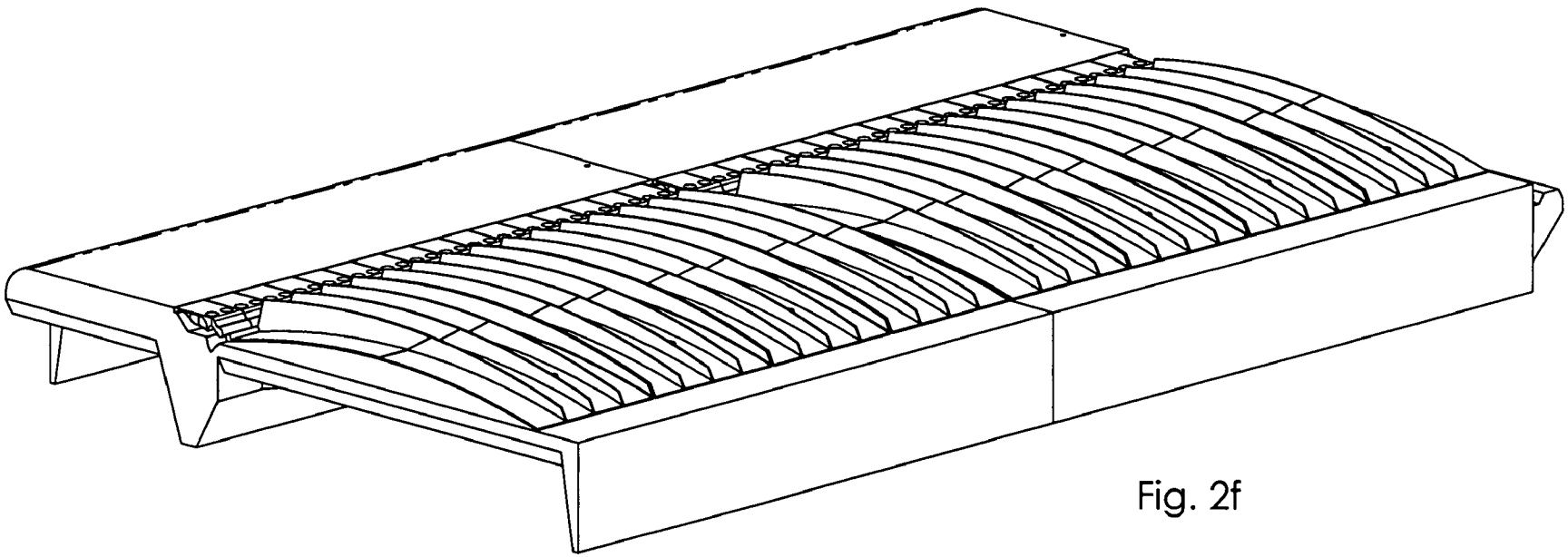
Figure 2G:
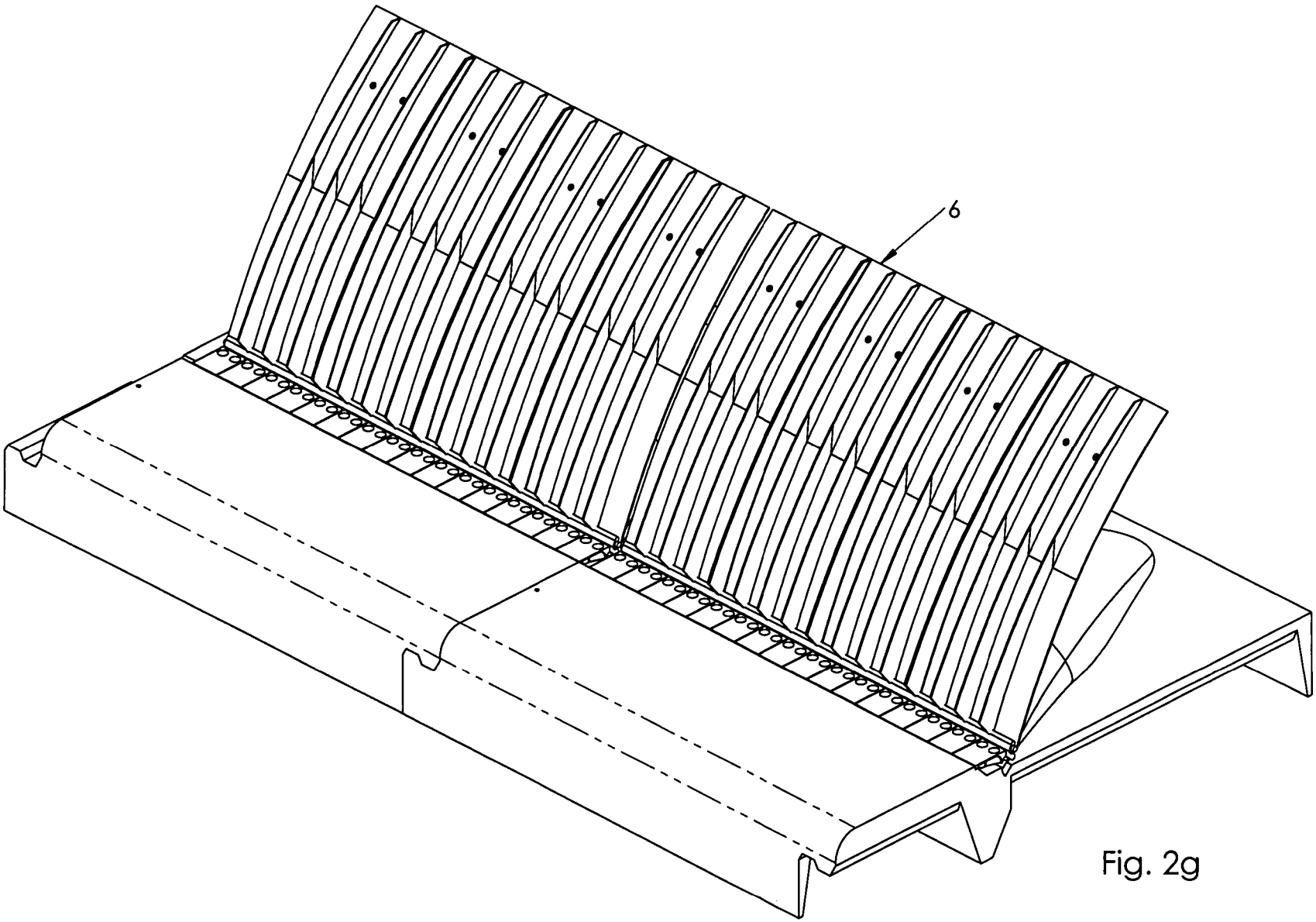
Figure 2K:
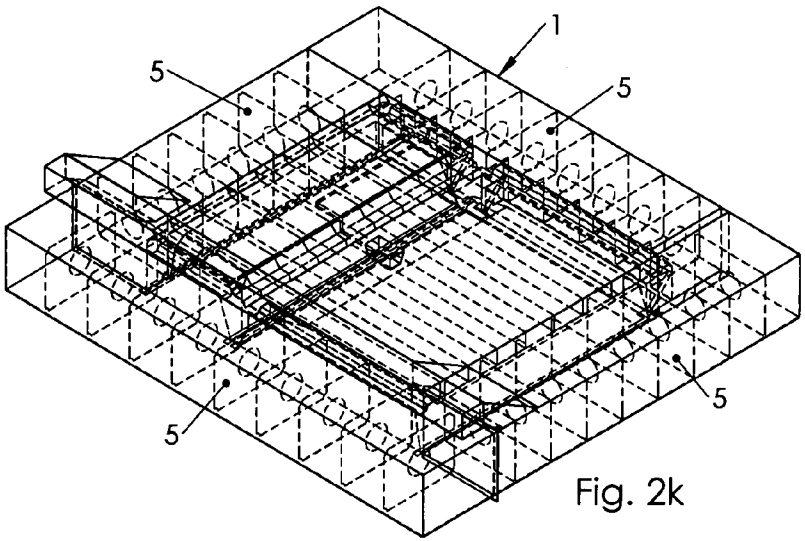
Figure 2H:
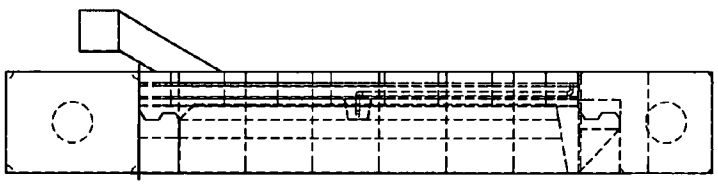
Figure 2J:
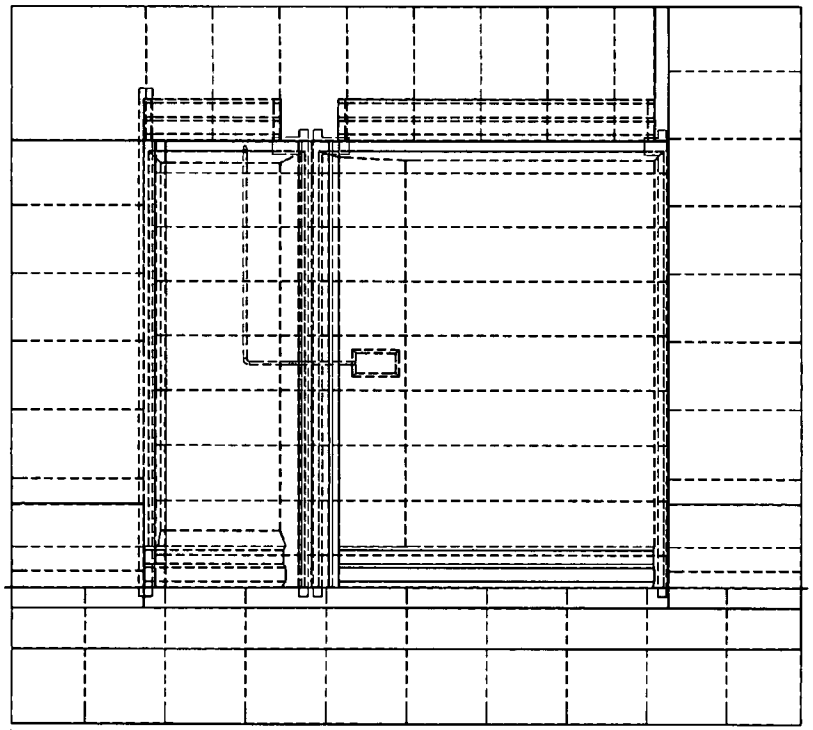
Figure 2I:
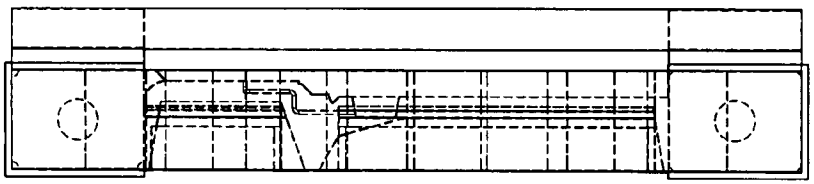
Figure 2I:
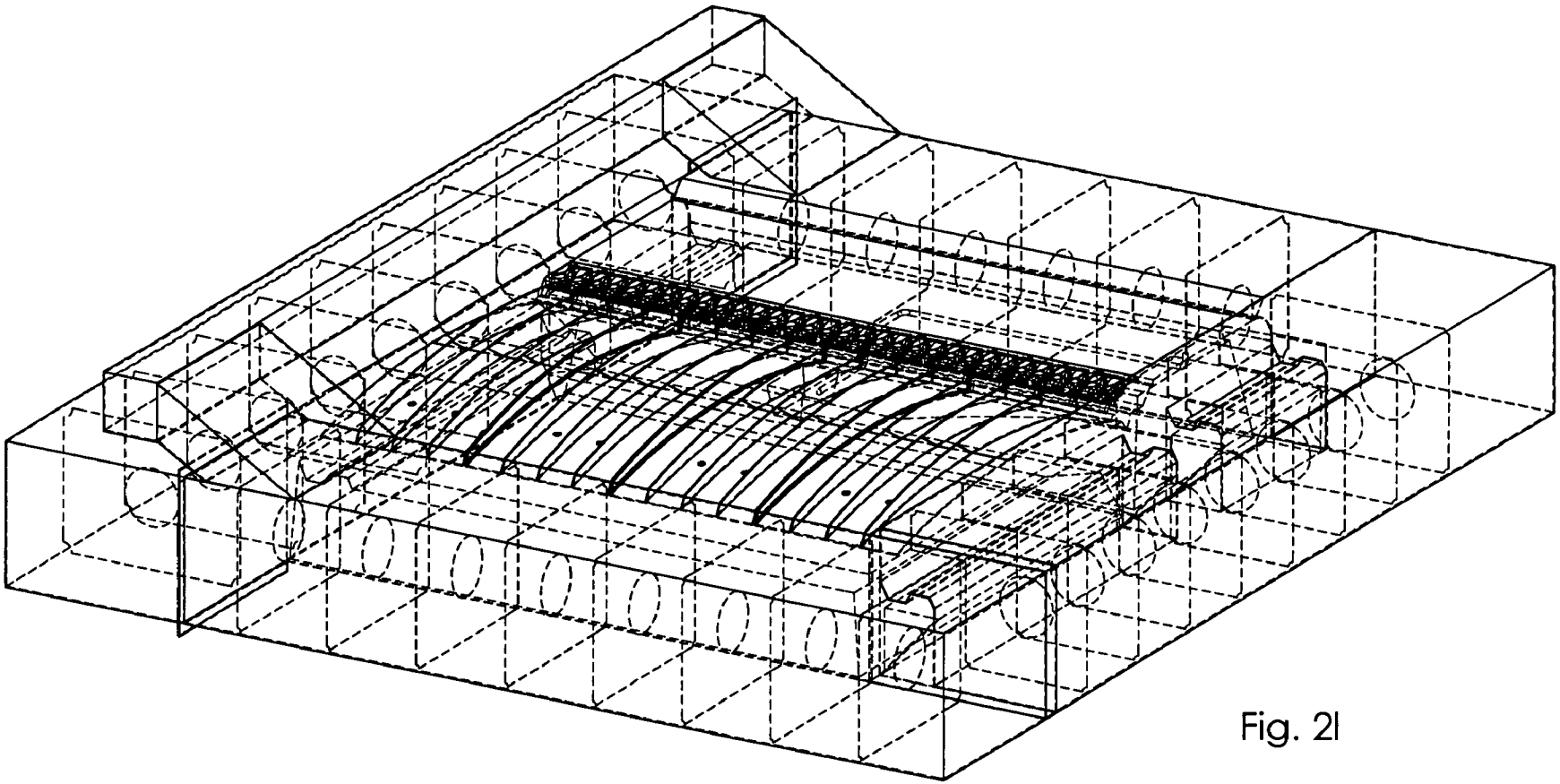
Figure 2M:
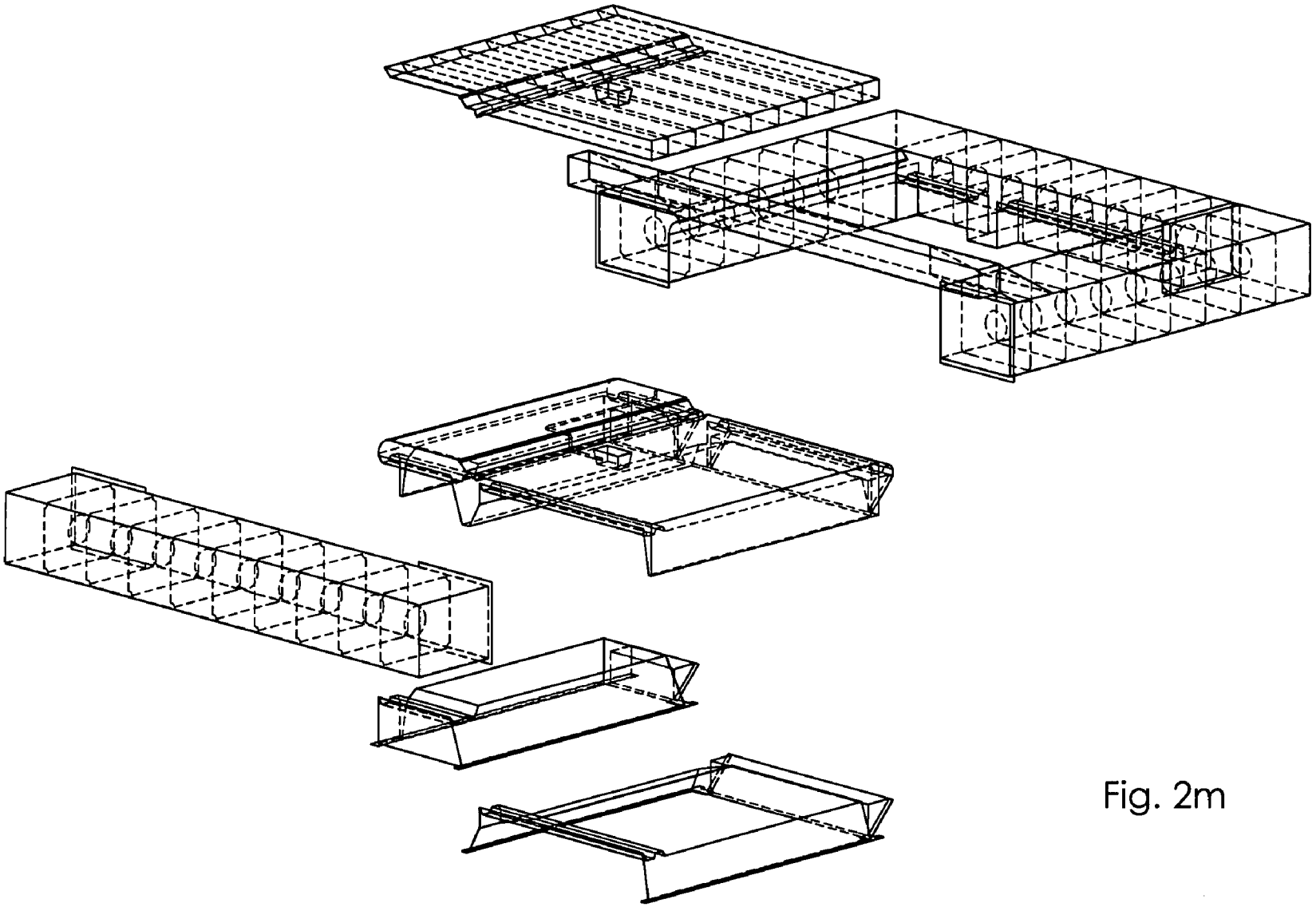
Figure 2N:
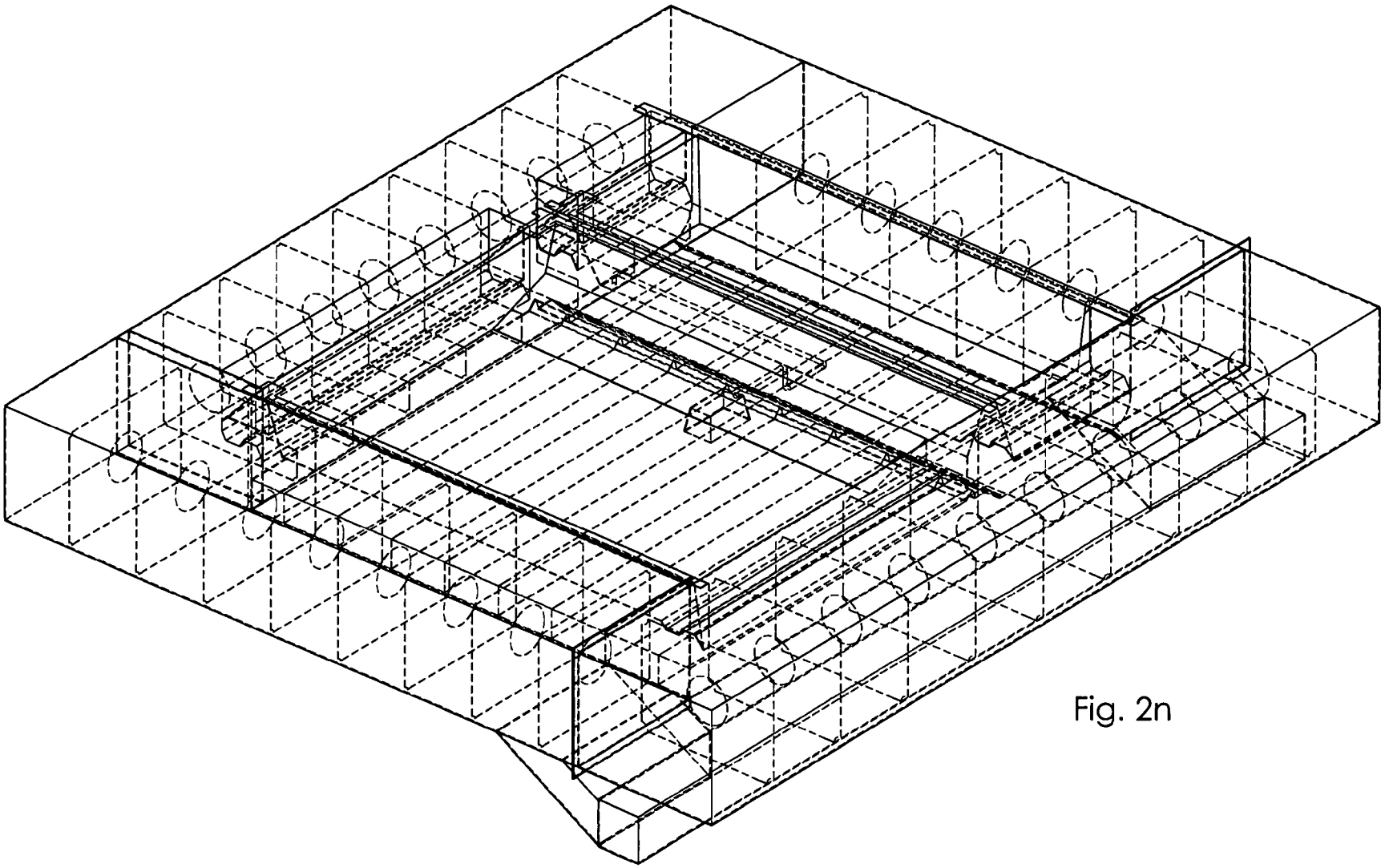

Referring to FIG. 2*a*, an exploded view shows floating form main structure 1*a*, removable gate mounting surface forming panel 1*b*, pre-cast shell end forming portion 1*c*, inside forms 1*d* and 1*e*, as well as pre-cast shell 4. Referring to FIG. 2*b*, pre-cast shell 4 is shown inside form portions 1*a* and 1*c*. Referring to FIG. 2*c*, the gate 6 is shown in place. Referring to FIG. 2*d*, form portion 1*b* has been removed. Referring to FIG. 2*e*, pre-cast shells are shown interlocked. Referring to FIG. 2*f*, floating form 1 has been removed. Referring to FIG. 2*g*, the gate system has been inflated and raised. FIGS. 2*h*through 2*n* show, in greater detail, floating form 1.

Figure 3:
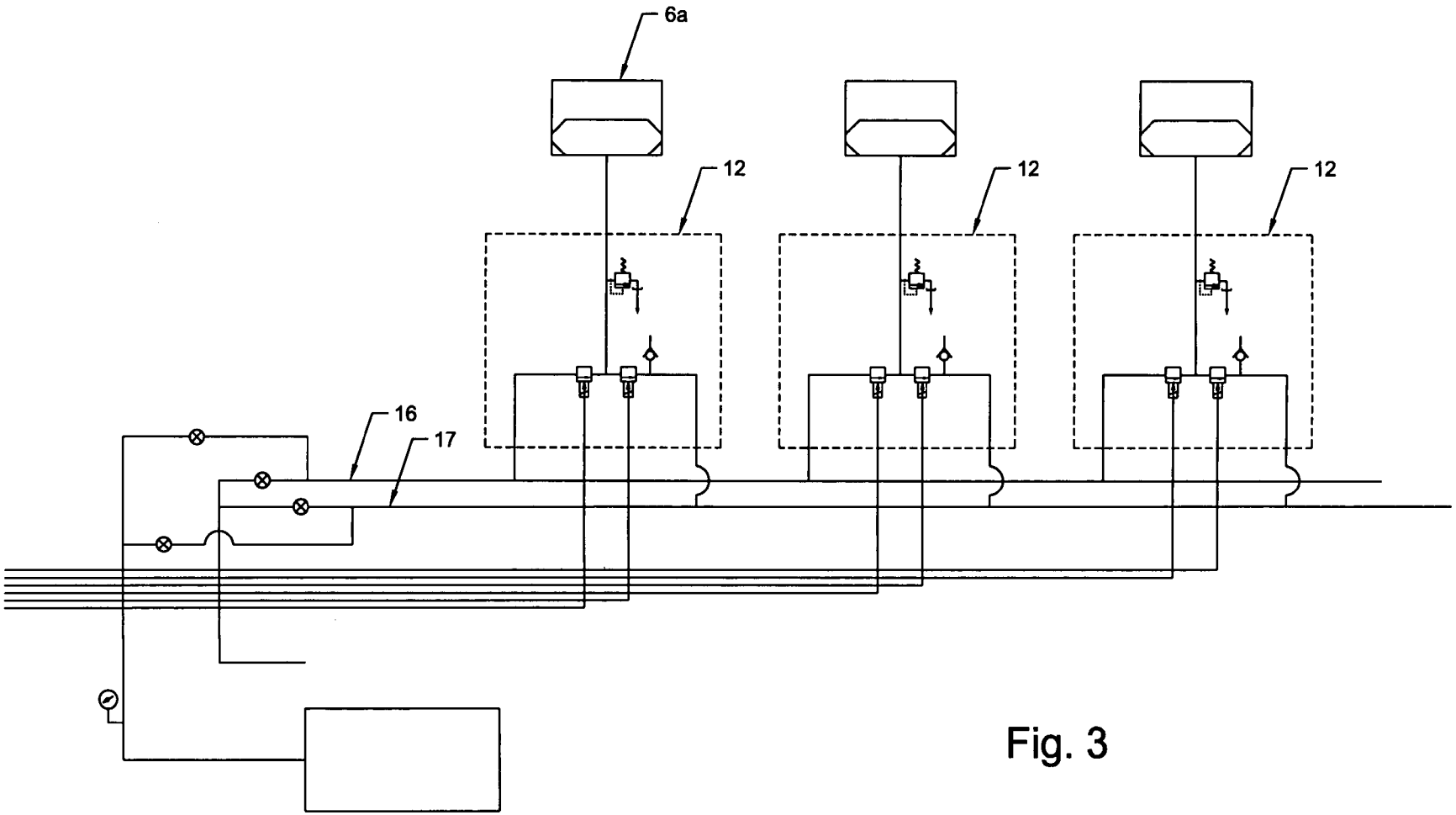
FIG. 3 is a pneumatic control schematic in accordance with one aspect of an embodiment of this invention.
Figure 4:
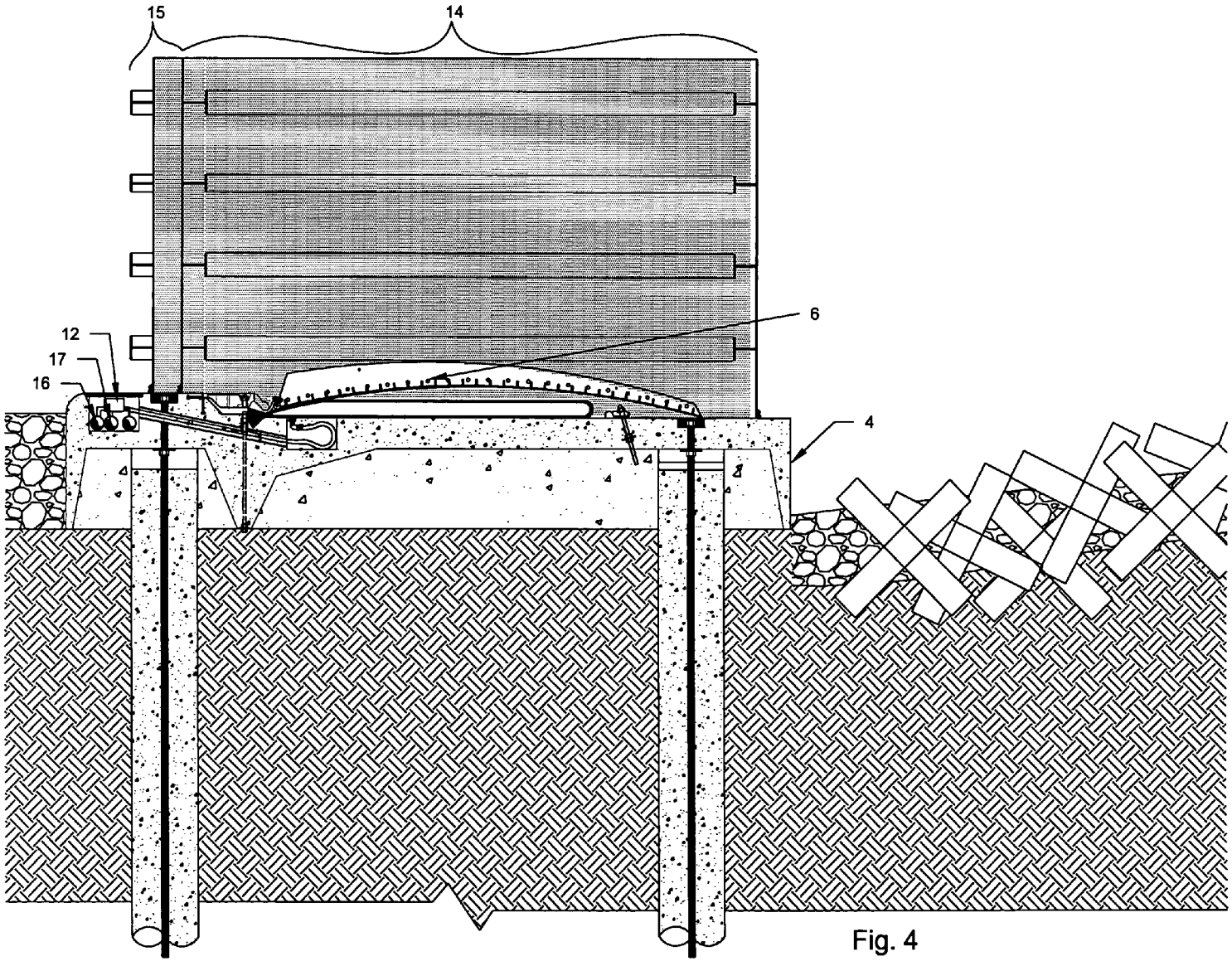
FIG. 4 is a sectional elevation view of a water control structure in accordance with an aspect of one embodiment of this invention.

Referring to FIG. 3, a control scheme is shown wherein valve SV-1 is operated by pilot air from a main control panel to admit air to gate 6*a*. Valve SV-2 may be actuated to release air. Pressure relief valve RV-1 prevents over-pressurization of gate 6. Check valve CV-3 allows pressure relief valve exhaust to escape underwater enclosure 12 as shown in FIG. 4 which contains components indicated by dashed line boxes on FIG. 3 representing underwater enclosure 12. Valves BP-1, BP-2, BP-3, BP-4 allow reversal of function in case of component failure between inflate line 16 and deflate line 17.

Figure 5:
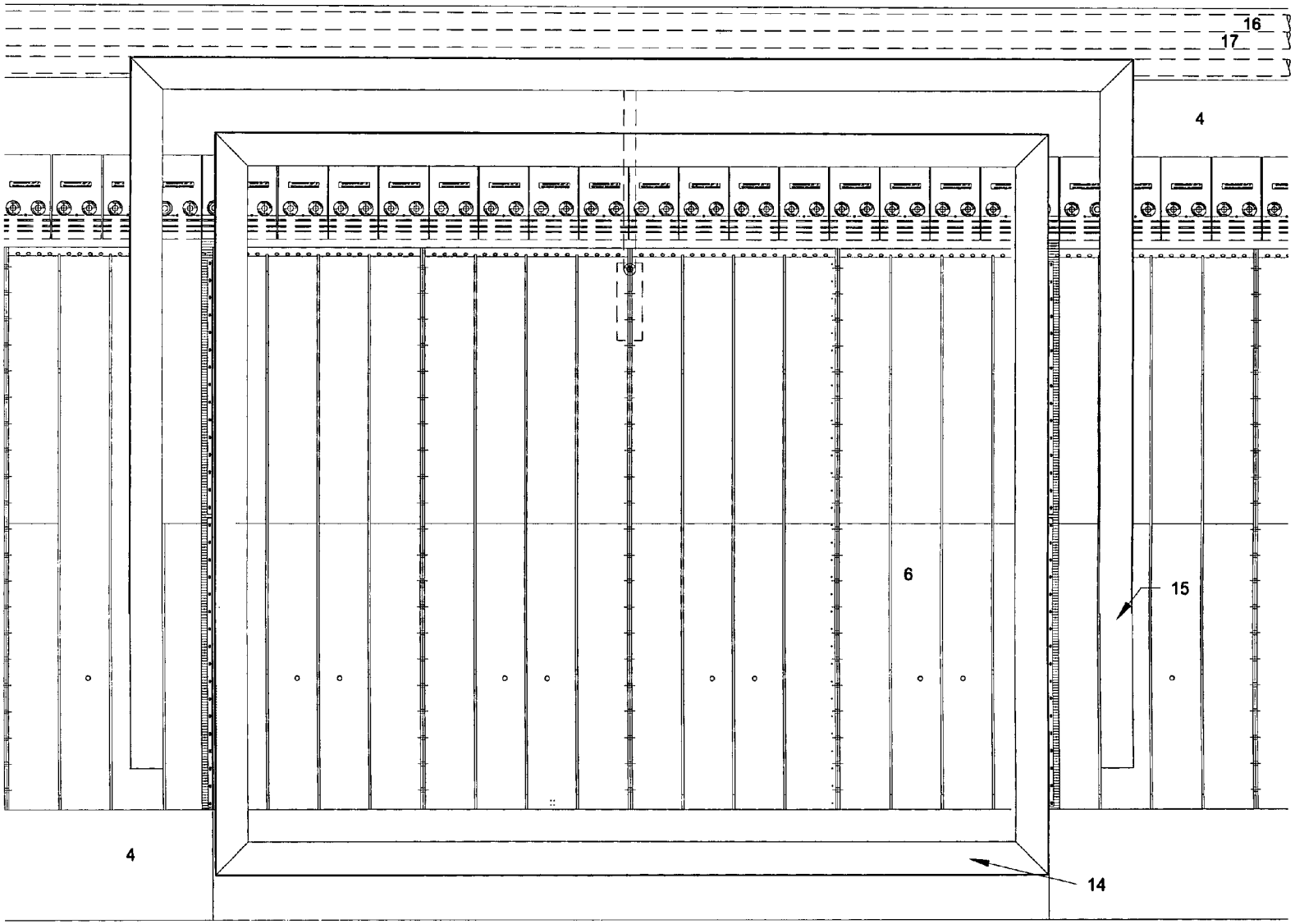
FIG. 5 is a plan view of a water control structure in accordance with one aspect of the present invention illustrating a dewatering bulkhead arrangement.

Referring to FIG. 4 and FIG. 5, valve enclosure 12 is shown connected to pipes 16 and 17 as well as to gate 6. Dewatering box 14 is shown, as is flow shutoff bulkhead 15. Flow shutoff bulkhead 15 allows flow to be stopped while dewatering box 14 is lowered onto lowered gate 6.

Figure 6:
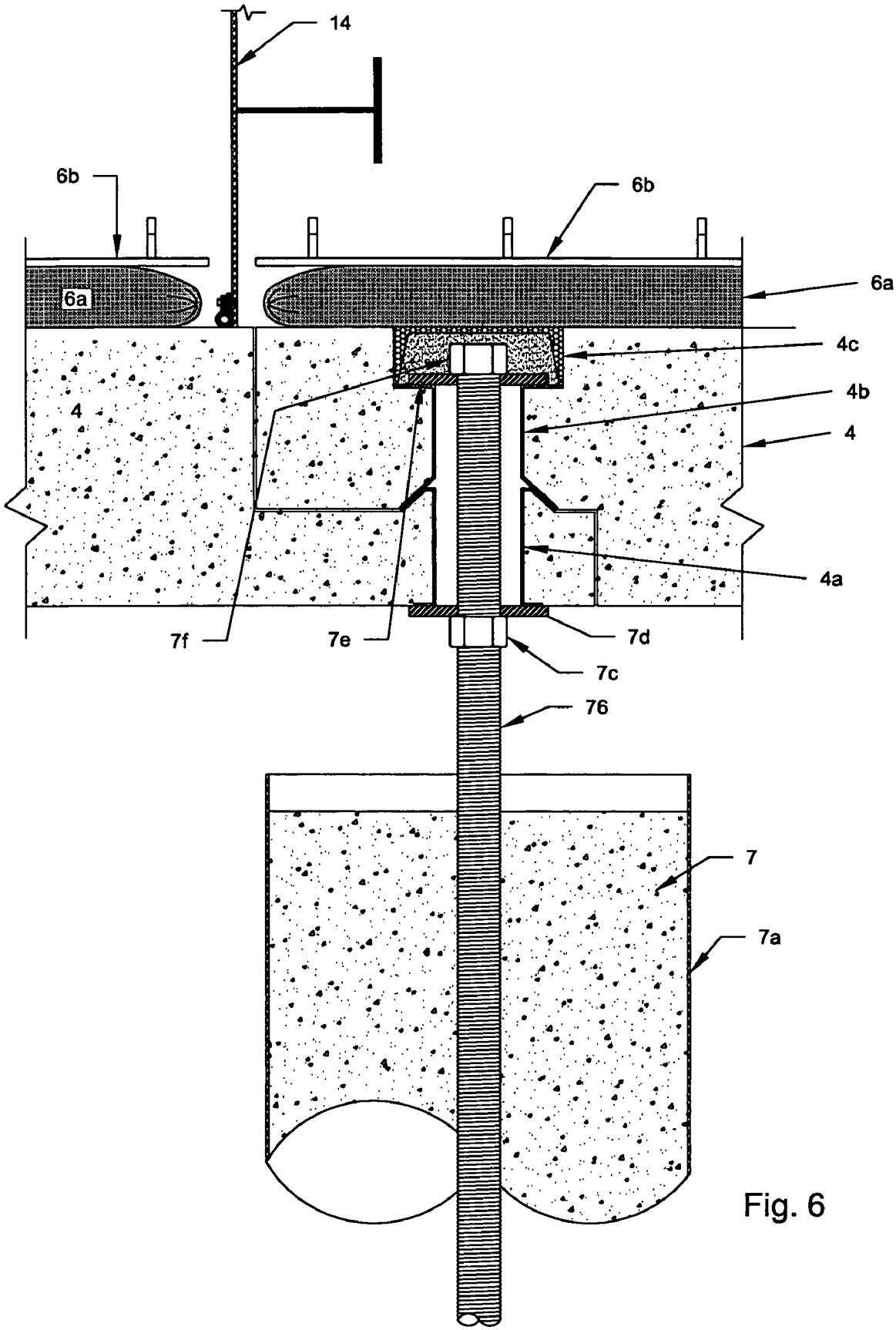
FIG. 6 illustrates a pre-cast foundation leveling arrangement in accordance with one aspect of the present invention.

Referring to FIG. 6, concrete pier 7 with casing 7*a* secures leveling bolt 7*b*. Nut 7*c* is adjusted to control the elevation of pre-cast slabs 4 which are held down against tremie concrete pressure by nut 7*f*. Dewatering box 14 fits between gate panels 6*b*. As can be easily understood from the foregoing, the basic concepts of the present invention may be embodied in a variety of ways. It involves both water control structures as well as a novel method of placing the foundations therefore. Devices to accomplish the appropriate method. In this application, water control techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for the full patent application. It should be understood that such language changes and broad claiming will be accomplished when the applicant later (filed by the required deadline) seeks a patent filing based on this provisional filing. The subsequently filed, full patent application will seek examination of as broad a base of claims as deemed within the applicant's right and will be designed to yield a patent covering numerous aspects of the invention both independently and as an overall system.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates.

Patents, publications, or other references mentioned in this application for patent are hereby incorporated by reference. In addition, as to each term used it should be understood that unless its utilization in this application is inconsistent with such interpretation, both traditional and common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Nonprovisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to claim at least: i) each of the water control systems as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the elements disclosed, xi) each potentially dependent claim or concept as a dependency on each and every one of the independent claims or concepts presented, xi) the related methods disclosed and described, xii) similar, equivalent, and even implicit variations of each of these systems and methods, xiii) those alternative designs which accomplish each of the functions shown as are disclosed and described, xiv) those alternative designs and methods which accomplish each of the functions shown as are implicit to accomplish that which is disclosed and described, xv) each feature, component, and step shown as separate and independent inventions, and xvi) the various combinations and permutations of each of the above.

It should also be understood that for practical reasons and so as to avoid adding potentially hundreds of claims, the applicant may eventually present claims with initial dependencies only. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. Further, if or when used, the use of the transitional phrase "comprising" is and will be used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

What is claimed is:

1. A method for manufacturing a water control system on the surface of a dam or waterway, the method comprising:

(a) providing a form structure including a base and multiple side walls; wherein said base includes a removable panel;

(b) placing concrete in said form;

(c) curing said concrete to form a pre-cast shell in said form;

(d) removing said panel from said base;

(e) inverting said form;

(f) installing a gate system on said pre-cast shell;

(g) positioning said inverted form on the surface of said dam or waterway;

(h) removing said form from said pre-cast shell.

2. The method of claim 1, wherein said form includes a ballast chamber system enabling said form to float in water with said shell in said form.

3. The method of claim 2, wherein said form is inverted by controlling the relative air and water content in said ballast chamber system.

4. The method of claim 1, wherein said gate system comprises a gate having a leadingedge pivotably mounted to said pre-cast shell.

5. The method of claim 4, wherein said gate system further comprises an inflatable bladder between said gate and said pre-cast shell; wherein said bladder is adapted to pivot said gate upwardly when said bladder is inflated.

6. The method of claim 1, wherein said form includes a removeable end portion.

7. The method of claim 1, further comprising the step of placing rebar or anchor bolts in said form prior to adding concrete thereto.

8. The method of claim 1, wherein the surface of said dam or waterway includes upright piers for supporting said pre-cast shell.

9. The method of claim 8, further comprising placing leveling bolts between said piers and said pre-cast shell enabling said pre-cast shells to be raised or lowered relative to said piers.

* * * * *